United States Patent [19]

Gryson et al.

[11] Patent Number: 4,815,498

[45] Date of Patent: Mar. 28, 1989

[54] PROCESS AND APPARATUS FOR MANIPULATING FALLEN DROP WIRES OF WEAVING LOOM WARP STOP MOTIONS AND FACILITATING REPAIR OF BROKEN WARP THREADS

[75] Inventors: Dirk Gryson, Dikkebus-Ieper; Henry Shaw, Vleteren; Michel Vandeweghe, Wijtschate-Heuvelland, all of Belgium

[73] Assignee: Picanol N.V., Belgium

[21] Appl. No.: 72,003

[22] Filed: Jul. 10, 1987

[30] Foreign Application Priority Data

Jul. 11, 1986 [NL] Netherlands ..... 8601819
Mar. 13, 1987 [BE] Belgium ..... 8700256

[51] Int. Cl.[4] ..... D03D 51/20
[52] U.S. Cl. ..... 139/351; 28/207
[58] Field of Search ..... 139/351, 353; 28/187, 28/205, 206, 207; 66/163

[56] References Cited

U.S. PATENT DOCUMENTS

| | | | |
|---|---|---|---|
| 869,643 | 10/1907 | McGuiness | 139/351 |
| 1,464,485 | 8/1923 | Rhoades | 139/351 |
| 1,560,809 | 11/1925 | Stone | 139/351 |
| 1,567,166 | 12/1925 | Northrop | 139/351 |
| 2,062,688 | 12/1936 | Turner | 139/351 |
| 2,512,165 | 6/1950 | Meier . | |
| 2,834,381 | 5/1958 | Grangier . | |

FOREIGN PATENT DOCUMENTS 708306 of 1931 France .

*Primary Examiner*—Henry S. Jaudon
*Attorney, Agent, or Firm*—Bacon & Thomas

[57] ABSTRACT

A process for manipulating fallen warp thread detector drop wires and revealing their location includes gripping and rotating a fallen wire, while spreading adjacent wires of the pack apart by a spreader and raising the fallen wire above the pack. Apparatus for gripping, rotating, spreading and lifting is disclosed.

7 Claims, 4 Drawing Sheets

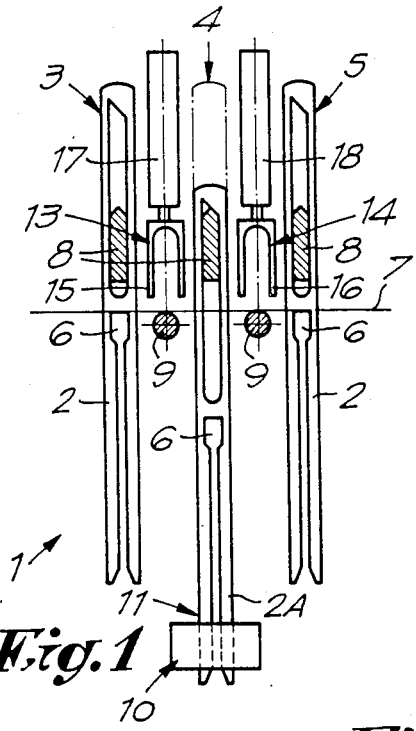
Fig. 1
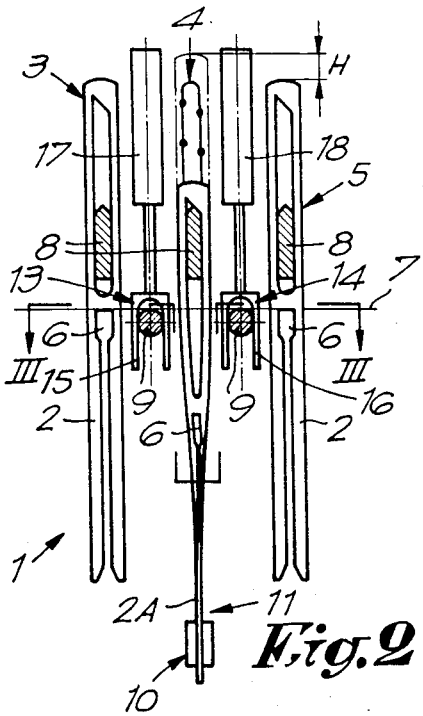
Fig. 2
Fig. 3
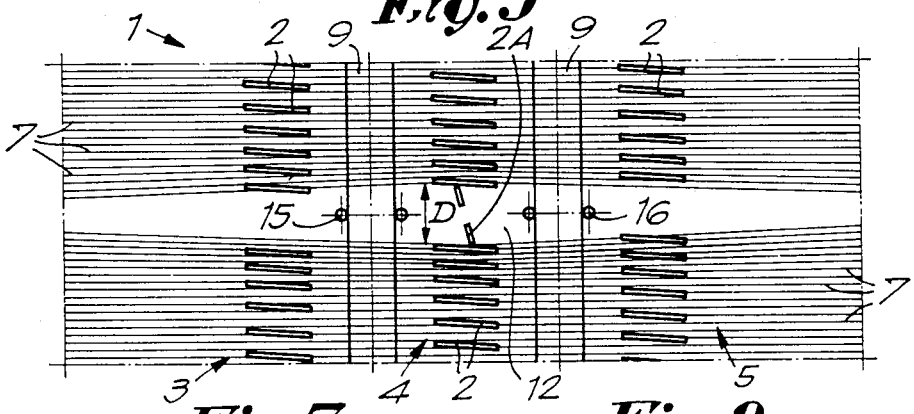
Fig. 7
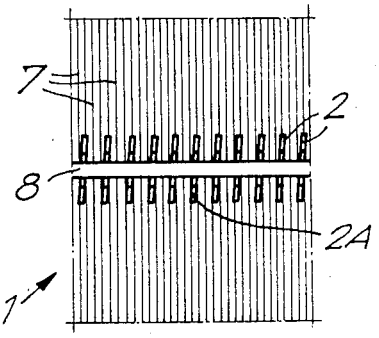
Fig. 8
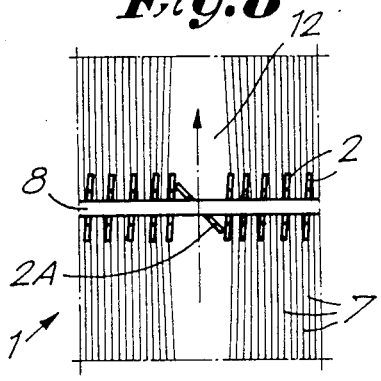

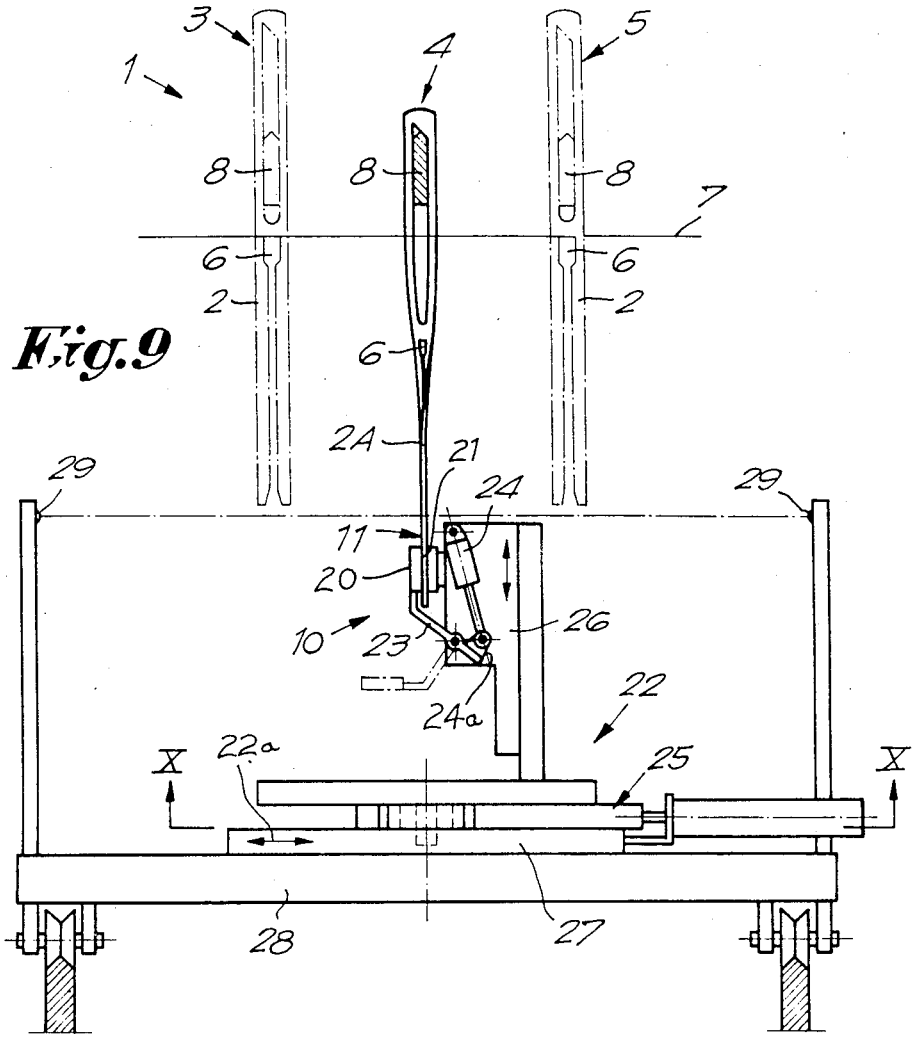
Fig. 9
Fig. 10
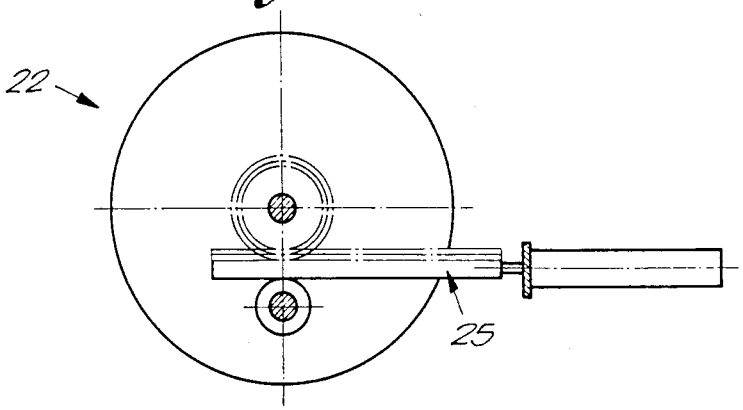

PROCESS AND APPARATUS FOR MANIPULATING FALLEN DROP WIRES OF WEAVING LOOM WARP STOP MOTIONS AND FACILITATING REPAIR OF BROKEN WARP THREADS

BACKGROUND OF THE INVENTION

The present invention concerns a method and apparatus to facilitate the repair of warp threads in weaving looms using a system for manipulating fallen drop wires.

Drop wires are conventionally used in warp detector systems. Each warp thread is threaded through a warp detector wire such that, in the event of a break in a warp thread, the corresponding wire drops vertically, whereupon the event is detected in an appropriate manner and the loom is stopped.

Taking into account the large density of the warp threads, i.e. 40 to 60 threads per cm., it is quite obvious that a very tight and compact drop wire system is required. The drop wires are thus always mounted in rows (hereinafter "packs"), wherein the wires of the same row come into contact with a common electrode when the wires drop to provide a signal that a warp thread has broken. As this wire package is very compact, it is obviously quite difficult for the weaver to determine a position of the broken warp thread and to carry out the repair of the broken warp. An improvement aimed at facilitating the repair of a broken weft is described in U.S. patent application Ser. No. 014,778 filed Feb. 13, 1987 and commonly owned with this application. The aforesaid patent application describes a method whereby the fallen drop wire is caught by a gripper and moved above the wire pack in such a way that the weaver can easily carry out a repair. In order to achieve direct accessability with the hands to the wire involved, the adjacent drop wires are pushed laterally apart from each other by means of rotatable arms.

Although such a device provides a noticeable improvement over known warp detector systems, it has, however, the disadvantage that, owing to the position of the presented wire, it is quite difficult to carry out an automatic re-threading.

The present invention concerns a different method whereby the aforesaid disadvantage is overcome and whereby automatic re-threading of the wire is facilitated. This does not preclude, of course, manual repair of the warp thread.

SUMMARY OF THE INVENTION

The method in accordance with the present invention mainly comprises the detection of a fallen drop wire, gripping the fallen wire and rotating the wire about its lengthwise axis to a predetermined angle. The rotation of the drop wire offers the advantages as described below (which may or may not be usable at the same time).

The main advantage of the invention is the fact that the rotation of the wire makes the location of the warp break more clearly evident to the weaver.

Another advantage is that the adjacent drop wires are locally pushed or spread apart from each other whereby accessability to the fallen drop wire is improved and whereby auxiliary spreader elements then can be introduced between the wire pack in order to push the adjacent wires still further apart from each other.

Another advantage is that the rotation of a fallen drop wire places the wire and its thread opening in a plane which is located in cross-direction or nearly cross-direction relative to the direction of the warp threads, whereby re-threading can be carried out more easily by using an automated device. Quite obviously, the removal of the broken warp thread is also facilitated.

BRIEF DESCRIPTION OF THE DRAWINGS

In order that the characteristics of the invention will be better understood, the preferred embodiments are described and illustrated by way of examples which are not to be regarded as limiting in any way. With reference to the Drawings:

FIGS. 1 and 2 are views across a warp stop motion of a loom across drop wire packs and illustrate the gripping and rotating a fallen drop wire in accordance with the invention;

FIG. 3 is a cross-section view along line III—III of FIG. 2;

FIGS. 7 and 8 illustrate still another alternative embodiment of the invention;

FIG. 9 shows apparatus according to the invention for carrying out the inventive process;

FIG. 10 is a cross-section view taken along line X—X of FIG. 9; and

DETAILED DESCRIPTION OF THE PREFERRED EMBODIMENTS

Figure 4:
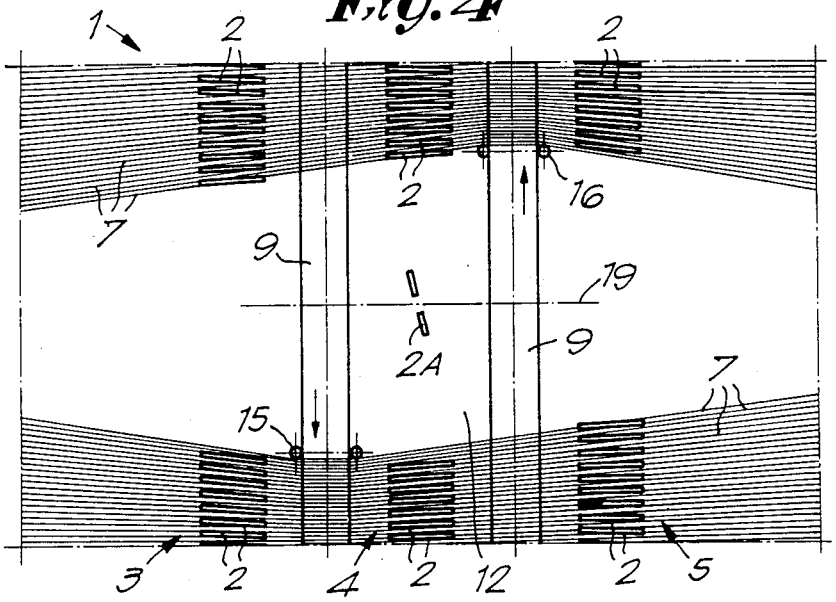
FIG. 4 is a view similar to FIG. 3, but whereby auxiliary spreader elements have been introduced between warp threads in order to push adjacent drop wires further apart from each other.

With reference to FIGS. 1 to 3, a warp detector stop motion 1 essentially comprises, as is already known, a large number of drop wires 2 which are mounted in rows (i.e., packs) respectively 3 to 5 of wires suspended on the warp threads 7 extending through thread openings 6.

For each row of drop wires 2, a common guiding element 8 is provided and generally is an electrode for providing a warp break signal upon contact with a fallen drop wire. Under the warp threads 7, support elements, i.e., support shafts 9, can also be mounted. When a break occurs in one of the warp threads 7, the corresponding wire 2 falls downwards, whereby contact is made with the electrode 8. The fallen drop wire will be indicated hereafter by the reference Number 2A. The fallen dropped wire 2A can be located according to a well known method, for instance by means of a moving detection device located under the wires as already described in U.S. patent application Ser. No. 014,778 mentioned above.

In order to facilitate the re-threading of the broken warp through the dropped wire, the method in accordance with the invention is resorted to. Specifically, as illustrated in FIG. 1, the fallen wire 2A is engaged or gripped underneath, for instance, by means of a clamping device 10 (See FIG. 10). Afterwards, the clamping device 10 and thus also at least the bottom end 11 of the wire 2A are rotated to a predetermined angle that is equal for instance to 90°, as illustrated in FIG. 2. In this way, an opening 12 with a width D is obtained along the length of the wire 2A involved (FIG. 3) because the transverse width of each drop wire is greater than the normal space between the wires of each pack in their warp detecting position, whereby the advantage is obtained that this wire 2A is made better accessible to the weaver.

Afterwards, spreader elements 13 and 14 preferably will be introduced into the opening 12 and will be then shifted apart from each other as illustrated respectively in FIGS. 3 and 4, whereby the adajcent drop wires 2 and the warp threads 7 running through these wires are shifted still further away from the dropped wire 2A in order to increase further the size of opening 12. These auxiliary spreader elements 13 and 14 may be of any arbitrary number and of an arbitrary kind. Essentially, the spreaders 13,14 can be supported by a suitable system for movement along and between adjacent packs of drop wires.

In the illustrated embodiment, these elements 13 and 14 comprise forks 15 and 16 that can be disposed over the support elements 9 at the right place; i.e., into the opening 12, by means of cylinders 17 and 18 and a locating device which is not illustrated. The forks 15 and 16 are then moved apart from each other in order to achieve the aforesaid effect.

Figure 5:
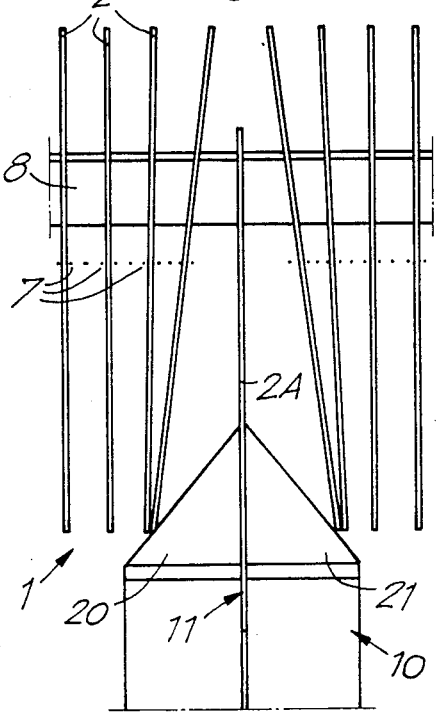
FIGS. 5 and 6 illustrate alternative embodiments of apparatus used to spread the drop wires.

Also in accordance with the method of the invention, the fallen wire 2A is elevated by means of the clamping device 10 as indicated in dotted lines in FIG. 2. Since the fallen wire 2A is rotated over about 90° at the height of the thread opening 6 relative to its normal position, re-threading can be carried out relatively easily, either manually or automatically, since this threading can occur along a direction 19 (FIG. 5) which is parallel to the direction of the warp thread 7.

Figure 6:
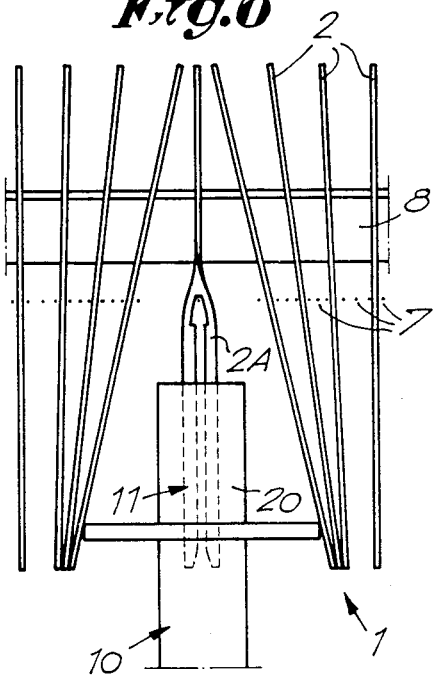

During the upwards movement, the wire 2A involved preferably will be rotated back to its normal warp detection position in order to avoid excess friction occurring between the twisted wire 2A and the corresponding electrode 8; and so that the clamping device is not unnecessarily heavily loaded and/or damaged. Before the re-threading is carried out, however, the clamping device 10 is brought back to its rotated position while the fallen drop wire is held at its elevated position (e.g., see FIG. 6).

Since possibly a threading element (i.e., a thread needle) must pass along the support elements 9 as well as through the thread opening 6 during the re-threading, the fallen wire 2A involved must be put in its highest position, i.e., higher than during the normal suspension to the warp thread 7. This is indicated in FIG. 2 by the height H where the fallen wire is shown in hidden lines.

According to an alternative solution of the method described hereabove, the rotation of wire 2A may be carried out only after the fallen wire has been elevated to its highest position, to thereby facilitate the re-threading while the adjacent warp drop wires 2 are not spread further apart. The pushing apart of the wires can indeed be carried out in another way. As illustrated on FIGS. 5 and 6, this can occur, for instance, by the use of a clamping device 10 having wedge-shaped arms 20 and 21.

In the embodiments described hereabove, drop wire 2A is shown as being twisted along its length relative to its rotation angle, but this is not necessarily always the case.

If, as illustrated in FIG. 7, the wires 2, and 2A are mounted with sufficient clearance on the guiding elements or the electrodes 8, the wires can be rotated over a sufficiently large angle without being necessarily twisted along their length. This latter embodiment is illustrated in FIG. 8. Quite obviously, as shown in FIG. 8 wire 2A is simply rotated over its full length.

The resulting advantage is that the wire can be engaged, for instance at its end above the electrode 8, in order to achieve the rotation while, on the other end, a re-threading can be carried out under the electrode.

Quite obviously, the fastening, the rotation and the re-threading can be carried out according to different alternative solutions either at the top end or at the bottom end of the drop wire 2, the chosen method depending upon the kind of wire used.

It is also obvious that the angle selected for rotation of the drop wire 2A at the height of the thread opening 6 need not necessarily be 90° but could be rather a function of the re-threading direction and of the size of the supplied threading element. Generally speaking, it can be stated that the fallen drop wire is rotated or twisted in such a way that the perpendicular projection of the thread opening 6 in a plane perpendicular to the re-threading direction is larger or equal to the width of the particular threading element used. The re-threading direction will normally be the aforesaid direction 19, although such is not necessarily always the case. The width of the aforesaid threading element is for instance, the diameter of the needle chosen for introducing a new thread through the wire 2A.

With reference to FIGS. 3 to 8, it should be remarked that the drop wires 2 are illustrated with a relatively large distance between each other for reason of clarity. Actually, in practice they are located nearly against each other at a distance less than the width of a drop wire.

FIGS. 9 and 10 schematically illustrate apparatus to put the method of the invention into practice. This apparatus mainly comprises a rotatable clamping table 22 whereon the aforesaid clamping device 10 is mounted with the grippers 20 and 21 in such a way that the clamping device 10 can be rotated.

The gripper 20 is actuated by means of a lever 23 and a pneumatic cylinder 24. As illustrated, cylinder 24 actuates lever 23 through a linkage **24*a***.

The rotatable clamping table 22 can be actuated for instance by means of a drive (i.e., rack and pinion) 25, as illustrated in FIG. 10.

The clamping device 10 can be moved upwardly and downwardly by means of apparatus like a vertically moving carriage 26, while the rotatable clamping table 22 is mounted on a horizontal carriage 27 capable of movement along a cross-direction **22*a* with respect to carriage 28, which can be driven or shifted under the drop wire packs. This carriage 28 also contains detection elements 29 in order to determine the position of the fallen drop wire 2A. Such a carriage 28 and the corresponding detection elements 29** are sufficiently described in the aforementioned U.S. patent application Ser. No. 014,778.

The operation of the apparatus in accordance with the invention can be clearly understood with reference to the drawings. Quite obviously the whole system can be preferably automated and, upon a fallen drop wire 2A being detected, the clamping device 10 can be automatically brought under this wire.

The gripping of the fallen drop wire 2A need not necessarily be carried out be means of a movable clamping device.

According to an alternative solution, this gripping can also be achieved, for instance, by means of a gripping element with a groove-shaped notch which engages the wire 2A while a rotation movement is applied afterwards to this element.

Quite obviously if another kind of warp detector wire is used, whereby, for instance, the thread is pulled above the electrodes, the method of the present invention remains also applicable if the gripping and rotating device is suitably designed.

Figure 11:
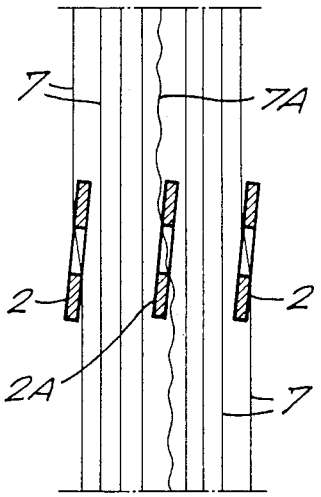
FIGS. 11 to 14 illustrate the rotation of the drop wire with a part of the broken warp thread present in the drop wire.

The description up to now implies that the broken warp thread 7A is no longer present in the fallen wire 2A. In most of the cases, however, this broken warp thread 7A or at least part of it will still run through the wire 2A, as illustrated in FIG. 11. In such a case, the method in accordance with the present invention is carried out preferably stepwise as illustrated on FIGS. 12 to 14, whereby the rotation direction of the wire 2A is of essential importance.

Figure 12:
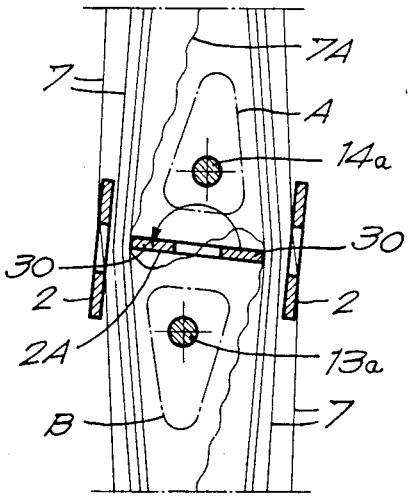

In a first phase, as shown in FIG. 12, the fallen wire 2A is rotated in such a way that its legs 30 are rotated relative to the warp thread 7A in such a way that this thread is further engaged between the warp detector wire 2A and the adjacent warp threads 7 and warp detector wires 2. Consequently, two areas A and B, where no warp thread is present with a good clearance (including the broken warp thread 7A) and where the spreader elements 13*a* and 14*a* may be deposited is obtained in the diagnonal direction relative to the fallen warp detector wire. Spreader elements 13,14 need not necessarily be shaped as forked elements.

Figure 13:
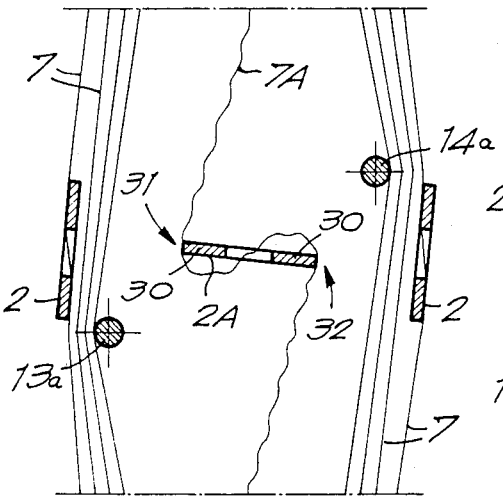

As illustrated in FIG. 13, the spreader elements 13*a* and 14*a* (shown here as rods corresponding with forked elements 13,14 in FIG. 1) may be placed between warp threads in the openings A,B moved apart from each other whereby, as already described, a larger opening is provided around the fallen warp detector wire 2A.

As far as FIG. 13 is concerned, it should be also noted that the location of the broken warp thread 7A is clearly determined by the side edges 31 and 32 of the rotated warp detector wire 2A, whereby the possibility is created that the broken warp thread 7A can be fastened at these locations by means of catching devices (not shown) in order to carry out further operations.

Figure 14:
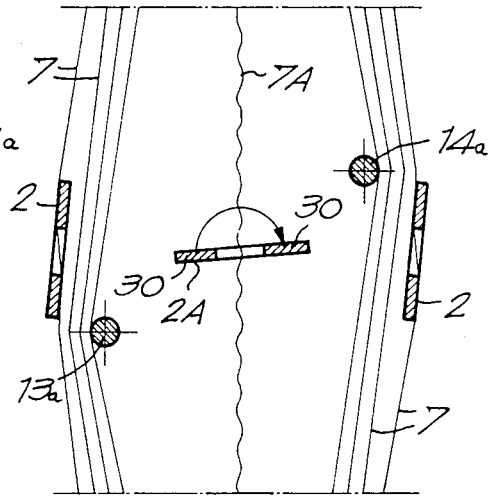

Finally, as illustrated in FIG. 14, the wire 2A can be rotated back in the other direction, whereby its legs 30 are rotated away from the broken warp thread 7A, in such a way that this thread is made completely free and can be removed without any problem from the wire 2A, whereby this warp detector wire 2A is then in a position suitable for re-threading.

The present invention is by no means limited to the embodiments described by way of examples and illustrated by the Drawings, bu the disclosed method to facilitate the repair of warp threads, the warp detector wires and the apparatus used can be put into practice according to a large number of alternative solutions without departing from the scope of the invention.

We claim:

1. A process for facilitating locating fallen drop wires in a warp stop motion for weaving looms wherein the stop motion includes adjacent drop wire packs arranged in rows, and wherein the drop wires of each pack have a transverse width greater than the normal space between drop wires in their warp detecting position, comprising:

upon the falling of a drop wire, rotating the fallen drop wire through a selected angle about its lengthwise axis to spread apart adjacent drop wires in the row including the fallen wire to create an enlarged spacing area between the adjacent drop wires;

inserting spreader means into the enlarged spacing area and further spreading apart the adjacent drop wires.

2. The method as claimed in claim 1, including the step of elevating the fallen drop wire above its normal warp detecting position after it is rotated and rethreading the raised drop wire while it is in its rotated condition.

3. The method as claimed in claim 2, including rotating the fallen drop wire back to its normal warp detecting position before it is elevated, elevating the fallen drop wire in its normal warp detecting position, and rotating it back to its rotated position before it is rethreaded.

4. The method as claimed in claim 1, wherein during the step of rotation, the fallen drop wire is rotated approximately 90°.

5. The method as claimed in claim 1, wherein a broken warp thread extends through the fallen drop wire, including the step of rotating the fallen drop wire towards a direction causing further engagement between the fallen drop wire and the broken warp thread to therbeby create said enlarged spacing area, said enlarged spacing area including open areas on opposite sides of the rotated fallen drop wire around which the engaged broken warp thread extends;

and wherein said inserting step includes inserting spreader means into each of said open areas before the further spreading of the drop wires.

6. A process for facilitating locating fallen drop wires in a warp stop motion for weaving looms wherein the stop motion includes adjacent drop wire packs arranged in rows, and wherein the drop wires of each pack have a transverse width greater than the normal space between drop wires in their warp detecting position, comprising:

upon the dropping of a drop wire, elevating the fallen drop wire above its normal warp detecting position;

rotating the elevated fallen drop wire through a selected angle about its lengthwise axis to spread apart adjacent drop wires in the row including the fallen wire to create an enlarged spacing area between the adjacent drop wires;

inserting spreader means into the enlarged spacing area and further spreading apart the adjacent drop wires.

7. A process for facilitating locating fallen drop wires in a warp stop motion for weaving looms, wherein the stop motion inludes adjacent drop wire packs arranged in rows, wherein the drop wires have a transverse width greater than the normal space between drop wires in their warp detecting position and including a broken warp thread extending through a fallen drop wire, comprising rotating the fallen drop wire through a selected angle about its longitudinal axis in a direction causing further engagement between the fallen drop wire and the broken warp thread, to thereby spread apart adjacent drop wires in the row including the fallen wire to thereby create an enlarged spacing area between the adjacent drop wires, said enlarged spacing area including open areas on opposite sides of the rotated drop wire around which the engaged broken warp thread extends;

inserting spreader means into said open areas and further spreading apart the adjacent drop wires;

rotating the fallen drop wire back to its warp detecting position to thereby effectively disengage the broken warp thread except for its extension through the threading opening of the drop wire.

* * * * *